United States Patent [19]

Whiteley

[11] Patent Number: 4,684,074

[45] Date of Patent: Aug. 4, 1987

[54] FLUID-OPERATED RAM

[75] Inventor: John Whiteley, Clitheroe, England

[73] Assignee: Hollingsworth UK Ltd., Accrington, England

[21] Appl. No.: 857,267

[22] Filed: Apr. 30, 1986

[30] Foreign Application Priority Data

May 3, 1985 [GB] United Kingdom ..... 8511390

[51] Int. Cl.[4] ..... B65H 54/42; B65H 63/02; B65H 63/08

[52] U.S. Cl. ..... 242/18 DD; 92/29; 92/84; 242/36; 242/37 R; 242/39

[58] Field of Search ..... 242/18 DD, 36, 37 R, 242/39, 65, 66; 92/84, 29, 14, 15; 226/162, 165, 166, 167

[56] References Cited

U.S. PATENT DOCUMENTS

| | | | |
|---|---|---|---|
| 1,816,352 | 7/1931 | Anderson | 242/39 X |
| 1,958,060 | 5/1934 | McKean | 242/37 R |
| 2,866,662 | 12/1958 | Nemeth | 226/166 X |
| 4,090,643 | 5/1978 | Wilkinson, Jr. et al. | 226/165 X |
| 4,165,829 | 8/1979 | Koveshnikov et al. | 226/167 X |
| 4,195,790 | 4/1980 | Reiners et al. | 242/37 R |
| 4,497,451 | 2/1985 | Guggemos et al. | 242/37 R |

FOREIGN PATENT DOCUMENTS

| | | |
|---|---|---|
| 1330154 | 9/1973 | United Kingdom . |
| 1391267 | 4/1975 | United Kingdom . |
| 2060777 | 5/1981 | United Kingdom . |
| 2134183 | 8/1984 | United Kingdom . |

*Primary Examiner*—Stanley N. Gilreath
*Attorney, Agent, or Firm*—Cort Flint

[57] ABSTRACT

A drive ram, particularly for a yarn winder, has the piston rod freely movable relative to both the piston and the ram cylinder in a first condition in which a locking washer is perpendicular to the longitudinal axis of the piston rod. Upon application of fluid pressure to effect relative movement of the piston and the cylinder, the locking washer is spring-urged against a wedge-like tipping washer which skews the lockingwasher and causes it to clamp the piston rod whereby the piston rod is then driven by the ram through a predetermined travel, from a starting position which is governed only by the diameter of the package at the time of operation of the package lift mechanism.

This allows a virtually constant lift travel of the ram, regardless of the diameter of the package at the time of operation of the ram.

9 Claims, 4 Drawing Figures

FLUID-OPERATED RAM

FIELD OF THE INVENTION

The present invention relates to an improved fluid power-operated ram. One application for a fluid poweroperated ram is in the lifting of a yarn package out of contact with its drive roll in textile winding machinery.

As the winding operation proceeds, the diameter of the build-up of yarn on the support core of the package increases and consequently if the drive roll is in a fixed position, which is normally the case, the package support axis of rotation moves relative to the axis of the drive roll. However, at a particular point in the winding cycle it is desirable to be able to move the package out of contact with the drive roll, through a given distance, so that the time taken to re-engage the package with its drive roll from the application of a "re-engage" signal will be constant, no matter what diameter the package has. One way of achieving this result is for a conventional ram to be connected to a ratchet mechanism so that as the package axis moves in response to increasing diameter of the yarn build-up in the package, the ratchet mechanism takes up a lot of the lost motion which would otherwise occur when the ram is operated, and thus when the ram is eventually operated to move the package away from its drive roll the travel involved very quickly results in separation of the package from the friction drive roll. However, even such a ratchet mechanism has the disadvantage that the compensation is not strictly accurate because of the tooth pitch of the pawl and ratchet mechanism.

Conventional fluid power-operated rams, for example hydraulically operated or pneumatically operated, normally execute a displacement from a known starting position and the travel of the ram is adjusted by the adjustment of the volume of fluid applied to the ram. Although U.S. Pat. No. 4,046,623 issued Sept. 6, 1977 to H. Schmid shows an adjustable travel of one pitch which then contacts a second piston on the same cylinder, there is no disclosure of a single ram in which the starting position can be automatically adjusted.

PRIOR ART

It is an object of the present invention to provide a ram which is capable of executing this adjustment function, and preferably with a much greater degree of accuracy than is possible with a ratchet and pawl system.

SUMMARY OF THE INVENTION

Accordingly, the present invention provides a fluid power-operated drive ram comprising a cylinder, a piston slidable in the cylinder, and a piston rod extending through one end of the cylinder and through the piston, characterized by means for selectively engaging the piston rod with either the piston or the cylinder for fluid pressure-operated actuation of relative movement between the piston and the cylinder, and by the fact that the piston rod is freely slidable with respect to the other of the piston and cylinder.

With such an arrangement, it will be appreciated that the drive ram has two separate conditions, one in which the piston rod is movable relative to both the piston and the cylinder, and the other in which the piston rod is locked relative to either the piston or the cylinder but movable relative to the other of those two components.

Although the present invention has been conceived with a particular problem in mind occurring in textile winding, the ram according to the invention has many different uses and the use in textile winding is but one of various different applications for the ram described and claimed herein.

BRIEF DESCRIPTION OF THE DRAWINGS

In order that the present invention may more readily be understood the following description is given, merely by way of example, with reference to the accompanying drawing in which.

DESCRIPTION OF BEST MODE

Figure 1:
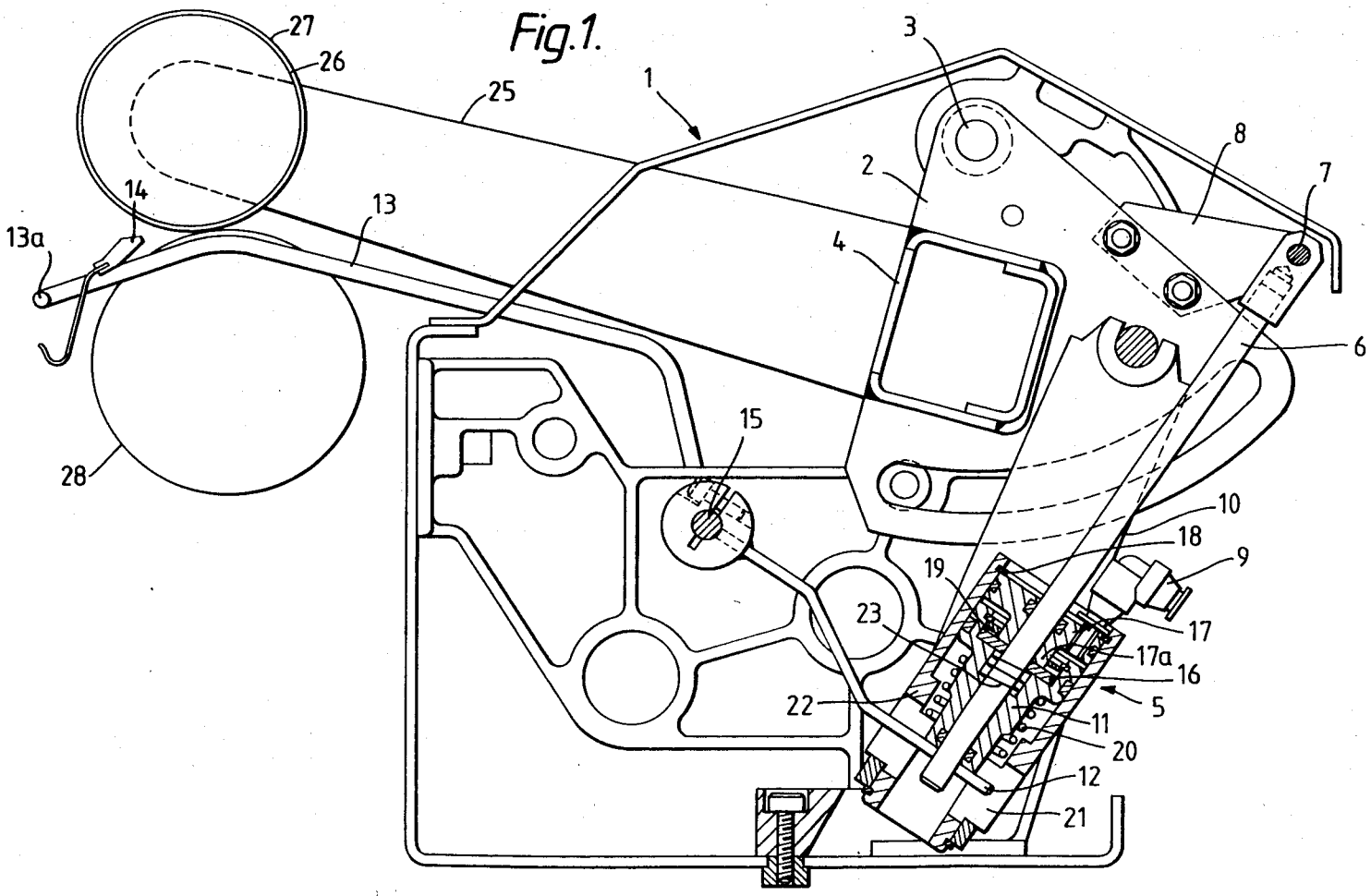
FIG. 1 is a vertical sectional view of a textile winding machine, taken on the longitudinal axis of the piston rod of one embodiment of drive ram in accordance with the present invention.

In the drawing, a textile winding machine 1 has a pair of quadrants 2 (only one of which can be seen in the drawing) each fixed on a spindle 3 allowing rotation of the quadrants about the axis of rotation of the spindle, the two quadrants supporting, between them, a square-section channel beam 4 which supports the conventional package arms 25 of the winder. Since the manner in which the package arms engage the freely rotatable support core 26 for a yarn package 27 to be wound, is conventional.

When the package is to be lifted clear of its friction drive roll, the two quadrants 2 are to be rotated in the clockwise direction through a given incremental angle which is just sufficient to draw the surface of the package, which may be conical or cylindrical, out of contact with the friction drive roll to a position which is always at a given constant spacing from the friction drive roll. When the package has been thus withdrawn, winding ceases and no further increase in the package diameter occurs.

When winding is to resume, the package is lowered into contact with the friction drive roll to impart driving rotation to the package at machine speed. The reacceleration of the package may occur either through resumed frictional drive contact with the drive roll 28 or through engagement with a separate drive roll which serves only to accelerate the package to machine speed.

Clockwise rotation of the segments 2 is achieved by virtue of a drive ram in accordance with the present invention, generally designated 5. The piston rod 6 of such drive ram is pinned, at 7 to a bracket 8 of one of the quadrants and thus the application of fluid pressure to the ram 5 by way of a quick-fit fluid pressure coupling 9 results in descent of the piston rod 6 through the desired travel.

The drawing also shows the exterior of a vibration damper 10 which may, for example, incorporate a preloading spring and will normally bias the quadrants in the anti-clockwise direction to hold the package in contact with the friction drive roll under a given contact force. Furthermore, the damper 10 will prevent bouncing of the package out of contact with its friction drive roll during the highspeed rotation of the package taking place upon yarn winding.

When the ram 5 is thus operated to pull the quadrants in the clockwise direction for separating the package and its drive roll, the piston 11 of the ram abuts one end of a drive arm 12 to a yarn bridge arm 13 whose free end comprises a yarn bridge 13*a* which rises to lift the yarn out of contact with the rapidly reciprocating traverse guide 14 of the winder. Similarly, when the package is re-engaged with its drive roll (by retraction of the piston 11 in the generally upward direction), the end 13*a* of the yarn bridge arm 13 descends to its illustrated position below the traverse guide 14 thereby allowing the yarn once more to contact the traverse guide 14, by virtue of the pivotability of the yarn bridge arm 13 relative to its pivot shaft 15.

Normally, during winding, the piston rod 6 is freely slidable relative to the piston 11, by virtue of the fact that a washer 16 of the ram has its internal diameter just large enough to clear the external surface of the piston rod 6 but as a very close fit therewith. The top end of the cylinder 22 of the ram is closed by a plug member 17 held captive by means of a circlip 18 and having an extension 17*a* which abuts the washer 16 and is surrounded by a further washer 19 whose axially opposite faces are not parallel to one another, so that in effect the washer 19 forms a wedge. The washer 19 is held in place by a further circlip housed in an internal groove of the piston 11.

As shown in the drawing, the constant thickness (i.e. parallel-faced) washer 16 which will hereafter be referred to as the locking washer is biased towards the plug 17 closing the ram cylinder 22, by virtue of a helical compression spring 23. Likewise, the piston 11 is itself urged towards the closing plug 17 by way of a separate, stronger helical compression spring 20.

The cylinder 22 of the ram includes a slot 21 to accommodate the movable free end of the drive arm 12 for the yarn bridge arm 13.

There are various seals in the ram, for example one sealing the piston rod 6 relative to the closing plug 17, a further sealing the exterior of the closing plug 17 relative to the internal wall of the cylinder 22, yet another sealing the exterior of the piston 11 relative to the internal wall of the cylinder, and a last seal at the end of the piston 11 remote from the closing plug 17 to seal the piston with respect to the piston rod 6.

The operation of the ram illustrated in the drawing is as follows:

During normal operation of the winder, the piston 11 is raised in the position shown in the drawing, and the piston rod 6 is able to move freely relative to the piston 11, and passes freely through the opposite ends of the cylinder of the ram 5. At this time there will be no application of fluid pressure to the quick-release fluid pressure coupling 9.

As winding proceeds, the package will build-up and its axis will move away from the axis of rotation of the friction drive roll with the result that the quadrants will progressively move in the clockwise direction about the axis of rotation of their spindle 3 and the pinned connection 7 between the bracket 8 and the piston rod 6 will cause the piston rod to slide downwardly through both the closing plug 17 and the piston 11. There is no impediment to the piston rod 6 projecting downwardly through the bottom of the cylinder during this yarn build-up operation.

As soon as the package is to be lifted clear of the friction drive roll, for example when the package is ready for doffing or when the package is to be stopped ready for a piecing-up cycle after a yarn break, fluid pressure is applied to the coupling 9 by virtue of a hose running back to a source of pressure signal, and the piston 11 begins to descend, i.e. to separate from the closing plug 17. As it does so, the influence of the non-parallel faced washer 19, hereafter called the pivot washer, and the spring 23 influences the locking washer 16 to rotate about the edge which is to the left in the drawing, i.e. the edge which is against the thickest part of the pivot washer 19. This causes the cylindrical bore in the centre of the locking washer 16 to skew relative to the piston rod 6 and as a result a wedging action occurs so that the piston rod 6 becomes clamped relative to the piston 11. As downward travel of the piston 11 proceeds, the piston rod 6 is itself pulled downwardly because of the skewing of the locking washer 16 and the descent of the piston and movement ceases only when the ram 5 has executed its known and predetermined travel. At the same time, descent of the piston 11 will cause clockwise rotation of the drive arm 12 and the yarn bridge arm 13 about the axis of rotation of the pivot shaft 15, lifting the yarn out of contact with the traverse guide 14.

When, at the appropriate time later during the piecing cycle, re-engagement of the package with its friction drive roll is required, fluid pressure is relaxed on the upper face of the piston 11, allowing the return spring 20 to lift the piston, thereby allowing gravity-biased return of the yarn bridge arm 13 back to the position shown in the drawing, to effect reengagement of the yarn with the traverse guide 14, and lifting of the piston rod 6 to rotate the quadrants 2 in the anti-clockwise direction sufficient to bring the package back into contact with its friction drive roll. At the end of the travel of the piston 11, the piston will press the locking washer 16 flat against the lower end face of the closing plug 17, restoring the locking washer 16 to a configuration in which it is exactly perpendicular to the longitudinal axis of the piston rod 6, thereby allowing the piston rod 6 to slide freely once more during growth of the buildup of yarn on the package.

Bearing in mind that during package doffing, the re-engagement of the now empty package support core or tube with the friction drive roll will occur when there is a much smaller diameter of the package (the empty core) it may be necessary to have the ram execute a double cycle in which the piston 11 rises before restoration of driving engagement to the tube, in order to re-set the piston rod 6 at the correct position relative to the piston 11, if the piecing cycle requires a precisely known time of resumption of drive to the empty yarn support core.

Figure 2:
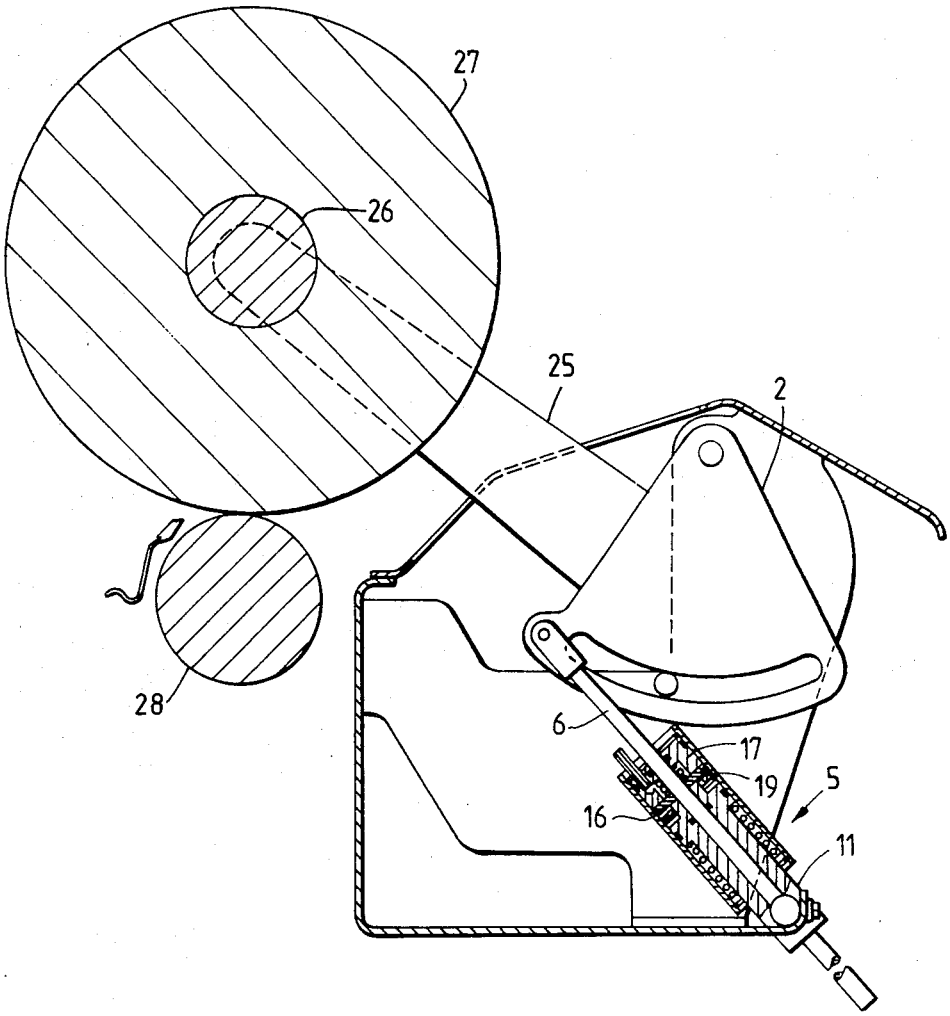
FIG. 2 is a view similar to FIG. 1 but showing an alternative embodiment of drive ram.

Although, in the embodiment shown in FIG. 1 the locking member 16 is carried by the piston 11 of the ram, FIG. 2 shows that it is alternatively possible for the cylinder 22*a* to be the ram component which carries the locking member 16*a*. In this case the orientation of the ram is changed so that the longitudinal axis of the piston rod 6*a* is now upwardly divergent leftwardly (rather than rightwardly as shown in FIG. 1) relative to the vertical and operation of the ram pushes the piston rod to pivot the quadrants 2 clockwise, rather than pulling them as shown in FIG. 1.

Figure 3:
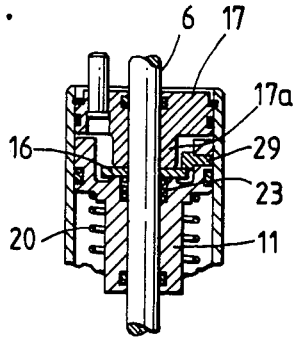
FIG. 3 is a detail of FIG. 1 but shows a modified form of abutment to operate the locking washer.
Figure 4:
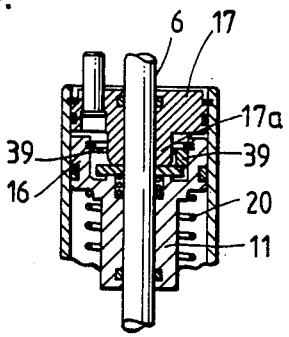
FIG. 4 is a detail of FIG. 1 but showing a modified form of pivot washer.

The precise pivoting mechanism used to tip the locking washer 16 may vary from that shown in the drawing. For example, it may be possible to provide for a projection (for example a radially extending peg such as peg 29 shown in FIG. 3) on one side of the piston but not the other, or the stepped pivot washer 39 of FIG. 4 may be used rather than the wedge-shaped pivot washer 19 shown in FIG. 1.

It is envisaged that the piston rod may be of a steel rod, for example of stainless steel, and the washer may be of case-hardened mild steel.

I claim:

1. A yarn winder incorporating winder frame means;

package support means to support a yarn package being wound;

friction drive roll means for rotating a said package;

traverse means for traversing a running yarn laterally to build up said package; and a fluid power-operated drive ram connected to said package support means and said winder frame means whereby operation of said ram actuates lifting of a wound yarn package away from said friction drive roll means upon application of fluid pressure to the drive ram;

said drive ram comprising:

(a) cylinder means;

(b) piston means slidable in the cylinder means;

(c) piston rod means having a longitudinal axis and extending through one end of the cylinder means and through the piston means;

(d) means for admitting fluid under pressure to said cylinder means;

(e) means for selectively locking the piston rod to one of the piston means and the cylinder means for fluid pressure-operated actuation of relative movement between the piston means and the cylinder means, wherein the means for locking the piston rod means is a locking member carried by said one of the piston means and the cylinder means and having bore means extending therethrough;

(f) means on said piston rod means having a substantially constant cross-section conforming very closely to said bore means to allow sliding of the piston rod means through said bore means when said bore means is coaxial with said piston rod means, said locking member having a first operative position in which the longitudinal axis of said bore means is coaxial with the longitudinal axis of the piston rod means, and a second position in which the longitudinal axis of the bore means is skew relative to that of the piston rod means; and (g) means carried by said one of the piston means and said cylinder means for driving said locking member into its second position when fluid pressure is applied to the ram, whereby the piston rod means is freely slidable with respect to the other of the piston means and the cylinder means when said locking member is in both said first position and said second position, and the piston rod means is able to slide relative to said locking member unless fluid pressure is being applied to the ram to cause said locking member to move to its second position, whereby the piston rod means may move freely relative to both the piston means and cylinder means of the drive ram when the yarn package is in operative contact with said friction drive roll means.

2. A yarn winder according to claim 1, wherein the locking member is carried by the piston means.

3. A yarn winder according to claim 1, wherein the locking member is carried by the cylinder means.

4. A yarn winder according to claim 1, wherein the locking member is a washer having opposed flat faces parallel to one another; and further including recess means in said one of the piston means and cylinder means for holding the locking washer, said means for driving said locking member into its second position including skewing means alongside said recess means for skewing the locking member during relative movement of the piston means and cylinder means of the ram.

5. A yarn winder according to claim 4, wherein said skewing means comprise a washer having a periphery of variable thickness and having a diameter at one end of which the washer periphery is thicker than at the opposite end of the said same diameter.

6. A yarn winder according to claim 5, wherein the skewing washer has opposed faces non-parallel, giving it a wedge-like form.

7. A yarn winder according to claim 5, wherein the skewing washer is of stepped formation.

8. A yarn winder according to claim 4, wherein said means for driving the locking member into its second position includes a spring urging the locking member towards said skewing means.

9. A yarn winder according to claim 1 including a yarn bridge arm co-operating with the yarn traversing means and means pivotally mounting said yarn bridge arm relative to said winder frame means, a yarn bridge carried by said yarn bridge arm and normally positioned below the yarn traversing means during package building winding, and means operably connecting said yarn bridge arm to said drive ram whereby package lifting operation of said drive ram pivots said yarn bridge arm to lift said yarn bridge for lifting the running yarn clear of the yarn traversing means upon actuation of the drive ram to lift the yarn package.

* * * * *